US010602823B1

(12) United States Patent
Duncan, Jr.

(10) Patent No.: US 10,602,823 B1
(45) Date of Patent: Mar. 31, 2020

(54) SMART HANDBAG

(71) Applicant: Ronald Christopher Duncan, Jr., Washington, DC (US)

(72) Inventor: Ronald Christopher Duncan, Jr., Washington, DC (US)

( * ) Notice: Subject to any disclaimer, the term of this patent is extended or adjusted under 35 U.S.C. 154(b) by 0 days.

(21) Appl. No.: 16/521,749

(22) Filed: Jul. 25, 2019

(51) Int. Cl.

| | |
|---|---|
| ***A45C 15/00*** | (2006.01) |
| ***A45C 3/06*** | (2006.01) |
| ***H04R 1/08*** | (2006.01) |
| ***A45C 13/08*** | (2006.01) |
| ***H04R 1/02*** | (2006.01) |
| ***A45C 13/02*** | (2006.01) |

(52) U.S. Cl.
CPC ..... *A45C 15/00* (2013.01); *A45C 3/06* (2013.01); *A45C 13/02* (2013.01); *A45C 13/08* (2013.01); *H04R 1/025* (2013.01); *H04R 1/08* (2013.01)

(58) Field of Classification Search
CPC ..... A45C 15/00; A45C 3/06; A45C 13/02; A45C 13/08; H04R 1/025; H04R 1/08
See application file for complete search history.

(56) References Cited

U.S. PATENT DOCUMENTS

| | | | | |
|---|---|---|---|---|
| 4,755,802 | A | 7/1988 | Urbanczyk | |
| 5,408,220 | A | 4/1995 | Brow et al. | |
| 5,920,260 | A | 7/1999 | Tseng | |
| 6,637,484 | B1 | 10/2003 | Kraft | |
| 8,674,211 | B1 | 3/2014 | Palmer et al. | |
| 8,763,289 | B2 * | 7/2014 | Childs | G06F 7/12 40/594 |
| 9,144,281 | B2 * | 9/2015 | Cross | A45C 5/14 |
| 9,198,492 | B2 * | 12/2015 | Chehebar | A45C 13/00 |
| 2004/0144665 | A1 | 7/2004 | Hartstein et al. | |
| 2006/0061546 | A1 | 3/2006 | Jong | |
| 2009/0320978 | A1 * | 12/2009 | Martinez | A45C 1/06 150/132 |
| 2012/0042996 | A1 * | 2/2012 | Glynn | A45C 15/00 150/106 |
| 2014/0041772 | A1 | 2/2014 | Hayes et al. | |
| 2016/0110809 | A1 | 4/2016 | Zhou | |
| 2017/0130951 | A1 * | 5/2017 | Carrasco-Slind | F21V 33/0004 |
| 2018/0172864 | A1 * | 6/2018 | Lin | A45C 1/02 |
| 2019/0328098 | A1 * | 10/2019 | Dao | A45C 3/00 |

FOREIGN PATENT DOCUMENTS

| | | | |
|---|---|---|---|
| CN | 201213546 | Y | 4/2009 |
| CN | 201356146 | Y | 12/2009 |
| DE | 102016115154 | | 2/2017 |
| GB | 2390206 | A | 12/2003 |
| KR | 20030041946 | A | 5/2003 |
| WO | WO2016159946 | A1 | 10/2016 |

* cited by examiner

*Primary Examiner* — Mohamed Barakat
(74) *Attorney, Agent, or Firm* — Bacon & Thomas, PLLC

(57) ABSTRACT

A handbag includes interior pockets or audible compartments that, when touched, provide an audible identification of contents, enabling objects to be easily retrieved despite the number of objects stored in the handbag and in a dark environment. The audible content identification may additionally be combined with a variety of additional "smart" or convenience features, such as audible reminders of items on a checklist input through a smartphone interface or memo pad or suggestions for hairstyles based on a weather report.

9 Claims, 2 Drawing Sheets

SMART HANDBAG

BACKGROUND OF THE INVENTION

1. Field of the Invention

The invention relates to a handbag with various smart features to enhance the appearance and usability of the handbag. The term "handbag" is intended to encompass a purse, pocketbook, tote bag, valet, or any article used to carry small items such as, by way of example and not limitation, keys, cosmetics, personal grooming items, coupons, medicines, money, credit cards, smartphones, and other personal articles.

More specifically, the invention relates to a handbag having internal pockets or compartments whose contents are audibly identified when a user touches a respective compartment.

The feature of audible content identification may additionally be combined with a variety of additional "smart" or convenience features. For example, the speakers that provide content identification may also be used to provide an alarm function or audible reminders of items on a checklist input through a memo pad or smartphone app, or to suggest hairstyles based on a weather report.

The handbag of the invention may further include, by way of example and not limitation, such smart or convenience features as GPS location, both to assist the user in navigation and also to locate a lost handbag; a bar code reader useable to keep track of items in a shopping cart or purchases; security or safety features such as a childproof lock; a USB port; a smartphone holder and charger, and an umbrella holder provided in an end panel of the handbag.

The handbag may also include aesthetic enhancements such as an extension plate with movable appendages that permits the appearance of the handbag to be varied

2. Description of Related Art

For many persons, handbags such as purses or pocketbooks have become repositories not only for money, but also for a variety of other items or articles including make-up and make-up applying or removing implements, hair brushes, combs, nail clippers, electronics, tissues, coupons, house and car keys, medicines, eyeglasses, cigarettes, matches or lighters, and so forth.

In a conventional purse, all items are deposited into a single space in the interior of the bag. In order to retrieve an object, the user must dig through or pull out a number of other objects until the desired item becomes visible, or the user must attempt to identify and retrieve the desired object by feel. This is not only inconvenient and sometimes embarrassing, but also dangerous in that it can allow a criminal to see what is in the purse and snatch items, or distract the user and leave the user vulnerable to assault. This is especially true at night or in areas with low light.

The present invention solves this problem by providing pockets or compartments inside the handbag that audibly announce their contents. This is superficially similar to the concept proposed in Chinese patent publication (CN2013/56146), which also involves a handbag with separate internal compartments and a speaker. However, the speaker is not used to identify the contents of the compartments, but rather to generate an alarm when certain items such as keys or wallets are not present in the handbag. The purpose is to ensure that the user does not forget to take those items, rather than to assist the user in locating the items. The problem with most handbags is not that the user forgets to carry an object, but rather that the user has taken so many items that it is difficult to find and retrieve a particular item when needed. The Chinese publication does not address this problem.

The feature of audible content identification may be combined with a variety of additional "smart" features that enhance the utility, attractiveness, or utility of the handbag, including features described in various prior publications. For example, digital displays for purses and backpacks are disclosed in U.S. Patent Publication No. 2014/0041772 and International Patent Publication No. WO 2016/159946. The handbag of the present invention could also include displays of the type disclosed in the prior publications.

The inclusion of a bar code reader on the outside of a handbag, as well as such smart features as built-in GPS, a fingerprint lock, a touch screen, a wireless charger, Bluetooth and Wi-Fi communications, wireless charging, and an NFC device for electronic payments, is disclosed in Chinese patent publication CN201213546. The bar code reader can be used to read coupons or vouchers, although there is no suggestion that it can be used to keep a running total of purchases, which can be a feature of certain embodiments of the present invention.

Known security features that could be included in the handbag of the present invention include circuitry that detects and sounds an alarm when tension is applied to the strap, indicating an attempted theft, are disclosed in U.S. Pat. Nos. 5,920,260 and 5,408,220, and British patent publication GB2390206. In addition, U.S. Pat. No. 4,755,802 and Chinese patent publication CN201213546 each discloses an alarm that sounds when a purse is opened; and Korean patent publication KR20030041946 discloses an alarm that sounds when a purse strap is cut. Either of these types of alarms, as well as other known security features, can be used with the present invention.

Finally, the following patents and publications may be of interest as background for their disclosures of purses or handbags that incorporate additional electronic devices: U.S. Patent Publication Nos. 2016/0110809; 2006/0061546, and 2004/0144665; U.S. Pat. Nos. 8,674,211 and 6,637,484; and German Patent Publication DE102016115154.

SUMMARY OF THE INVENTION

It is a first objective of the invention to provide a handbag having advanced smart features that enhance the utility and attractiveness of the handbag.

It is a second alternative objective of the invention to provide a handbag configured to make it easier to locate and retrieve contents of the handbag.

It is a third alternative objective of the invention to provide a handbag that can include a variety of additional smart features, such as the ability to suggest hairstyles based on weather conditions, or provide audible reminders based on a list input by the user.

It is a fourth alternative objective of the invention to provide a handbag with enhanced aesthetic or decorative features, such as an extension plate have unique movable appendages.

These and other objectives of the invention are achieved, in accordance with the principles of preferred embodiments of the invention that seek to achieve one or more of the above objectives, by a handbag having internal pockets or compartments whose contents are audibly identified when a user touches a respective compartment.

The content identification feature may be combined with one or more additional smart or convenience features including: GPS location, both to assist the user in navigation and also to locate a lost handbag; a bar code reader useable to keep track of items in a shopping cart or purchases; security or safety features such as a childproof lock; a USB port; a camera; a smartphone holder and charger; wireless communications capabilities including Bluetooth; a data entry keypad or touch panel; and an umbrella holder provided in an end panel of the handbag.

The feature of internal compartments is implemented, in a preferred embodiment of the invention, by providing a plurality of pockets or compartments on an interior of the handbag, each of the pockets or compartments provided with a touch sensor connected to a central processor and speaker. The touch sensor provides a signal indicative of the location of the sensor being touched. A programmable look-up table or equivalent memory circuit correlates the location of the sensor with an indication of contents, and causes the speaker to playback the contents, for example by playing a content indicating word such as "keys" or "coins." The correlation between a particular location and the word played back when the location is touched may be preprogrammed, input through a button and microphone (for example by entering a programming mode, touching the sensor associated with a particular pocket, and speaking the content-indicating word into the microphone), or input through a smartphone app, which can display a map of the different pockets within the handbag and allow the user to type-in or select from a dropdown menu a content label for the pocket. The speaker, processor, and memory can also be used for additional functions or capabilities, such as, by way of example and not limitation, the capability to suggest hairstyles based on weather conditions, to provide audible reminders based on a list input by the user, and/or to assist in shopping for clothes The handbag may also include a decorative plate having a shape that enhances the appearance of the handbag, and that includes movable appendages whose motion is responsive to opening of the handbag. For example, the plate may be in the shape of a hummingbird and the appendages may be shaped and positioned to resemble wings that extend as the handbag is opened.

As noted above, any of the above features may be combined with any number of additional convenience or safety features, including features that utilize the processor provided to control audible content announcements, and/or integrated display or touch panels to facilitate input and display of information.

DETAILED DESCRIPTION OF THE PREFERRED EMBODIMENTS

Figure 1:
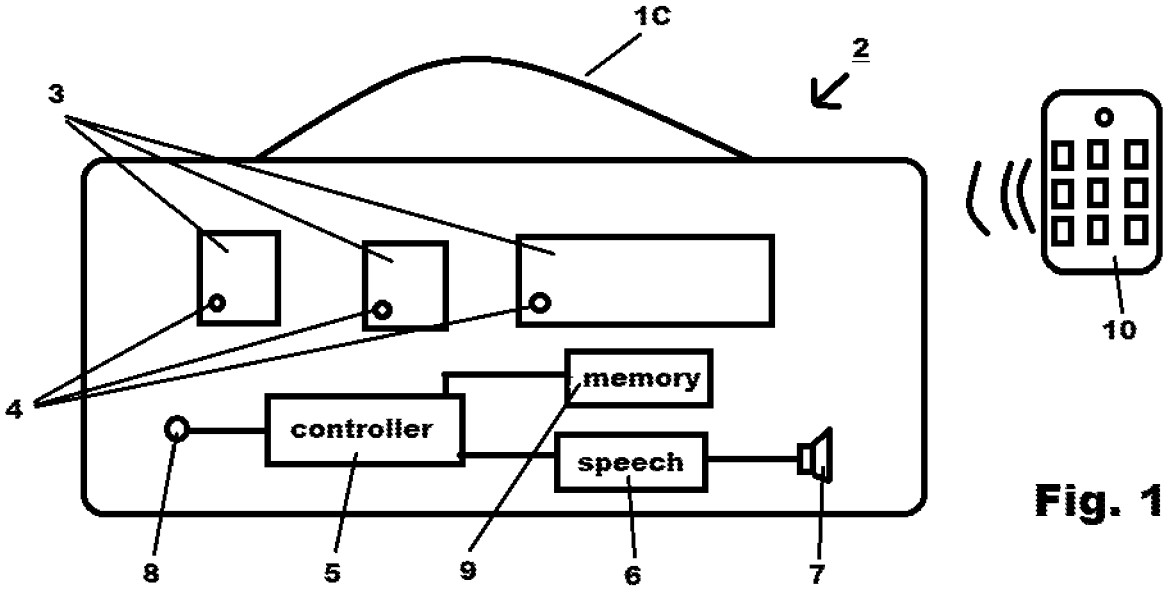
FIG. 1 is a side view showing an interior panel of a handbag with audible content indication, arranged in accordance with principles of a preferred embodiment of the invention.
Figure 4:
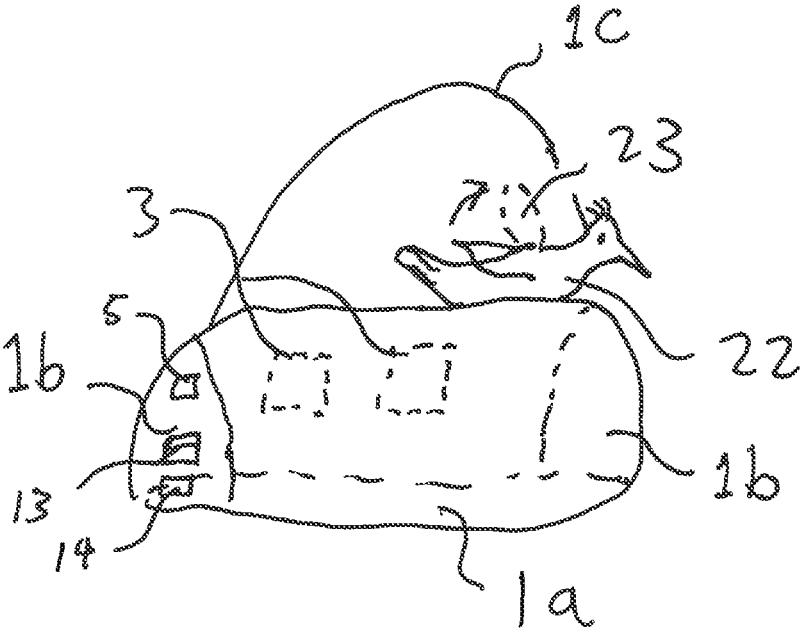
FIG. 4 is a side view of a handbag with a decorative extension plate having movable appendages in accordance with a variation of the preferred embodiment of the present invention.

FIG. 1 illustrates an interior of one sidewall 1 of a handbag 2 having an audible content indicating feature according to a preferred embodiment of the invention. The handbag may be a purse of the type that generally includes, as shown for example in FIG. 4, the sidewalls 1, a base 1*a*, endwalls 1*b*, and a carrying strap 1*c*, although the shape and configuration of the handbag may be varied without departing from the scope of the invention, and may include purse, pocketbook, tote bag, valet, or any article used to carry small items such as, by way of example and not limitation, keys, cosmetics, personal grooming items, coupons, medicines, money, credit cards, eyeglasses, smoking items, smartphones, and other personal articles.

Fixed to the interior of panel 1 are a plurality of pockets 3. The pockets 3 may be made of a variety of materials, including cloth, leather, mesh, and so forth, and may have a variety of shapes and sizes. In addition, the pockets may be open at the top or may include, by way of example and not limitation, a closure such as a flap, zipper, flap and zipper (not shown), or any other arrangement for preventing contents of the pocket from falling out of the pocket. The exact material, size, and configuration of the pockets forms no part of the invention, and may be adapted according to the type of item or article to be stored in the pocket, which may include keys, coins, electronic devices, or any other item or article that is carried within a handbag.

Each of the pockets 3, which may be included on one or both sidewalls or endwalls of the handbag, includes at least one touch or proximity sensor 4. Sensors 4 may include any sensor capable of outputting an electrical signal when touched or when a human hand or finger is in close proximity to the sensor. An example of such a sensor is a capacitive sensor whose electrical impedance changes when a finger contacts the sensor. Each of the sensors 4 is connected to a controller, and outputs a different signal, or is connected so that the controller 5 can determine which of the sensors 4, and therefore which of the pockets 3, has been touched. The controller 5 is configured to associate the respective pocket 3 with a content indicator, for example by using a look-up table that relates the pocket with the content. The controller 5 then causes a speech generator 6 to output a voice signal to the speaker 7, which causes the speaker 7 to provide an audible indication of the contents of the pocket that has been touched.

Power to the controller, speaker, and any other electronic devices or items may be provided by non-rechargeable or rechargeable batteries, including batteries that are chargeable through an optional USB charging input (not shown).

There are a variety of ways to associate pockets with a particular contents and therefore make possible the audible indications output by the speaker 7. One of the ways is to pre-designate particular pockets with corresponding contents. For example, one of the pockets 3 may be designated as a pocket for holding keys, another for holding make-up, and another for cash and/or credit cards.

Figure 2:
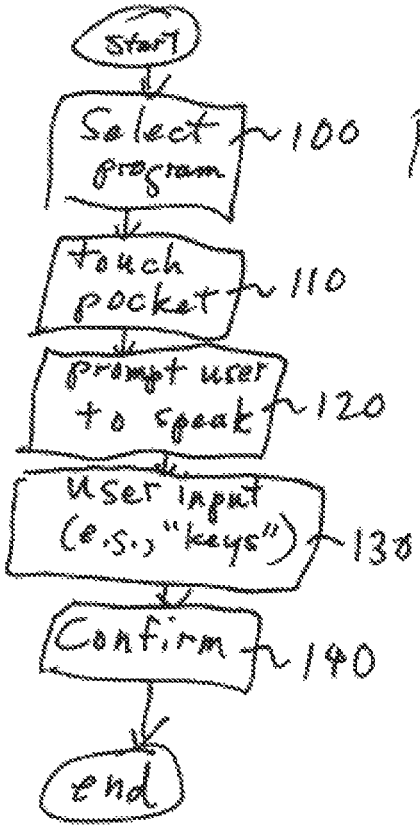
FIG. 2 is a flowchart of a programming method for the preferred embodiment of FIG. 1.

An alternative method for designating the pockets and associating them with corresponding audible indicators is illustrated in FIG. 2. According to this method, which is implemented by the controller 5 and a microphone 8 connected thereto, the user initially selects a programming mode (step 100), either by voice activation or by manipulating a button or switch (not shown). Upon entry into the programming mode, the user selects one of the pockets 3 by touching the selected pocket, so that the sensor 4 outputs a touch signal (step 110). The user is then prompted to say a content identifier, such as "keys" or "coins" (step 120). When the user says the content identifier, it is picked up by the microphone 8, associated with the last-touched pocket 3, and stored by the controller 5 in a memory 9 (step 130). The user then confirms the selection by again pressing the program mode initiation button or providing an oral confirmation (step 140), at which time the controller 5 exits the programming mode.

Figure 3:
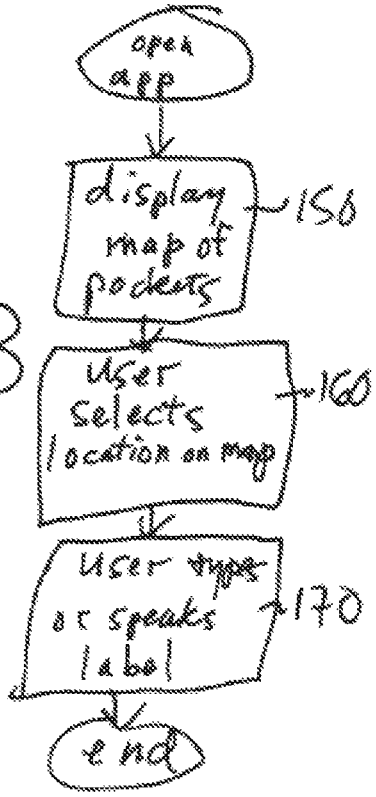
FIG. 3 is a flowchart of an alternative programming method for the preferred embodiment of FIG. 1.

Another alternative method for designating pockets and associating them with corresponding audible indicators is illustrated in FIG. 3. This method utilizes a smartphone 10, which may either be plugged into a receptacle or connector 14 on an exterior of the handbag, or in communication with the handbag via Bluetooth or another wireless connection. The method begins by displaying on the smartphone a map of the available pockets 3 (step 150). The user then selects one of the pockets by touching it (step 160), and then associates the pocket with a particular audible indicator (step 170) by either speaking into the microphone of the smartphone 10, selecting from a pop-up menu of different content possibilities, or typing in a content label, which may then be converted into an audible indicator by a text-to-voice converter. Once the content label is selected, the program ends, and the appropriate audible indication will be played whenever the corresponding sensor 4 indicates that a respective pocket 3 containing the sensor 4 has been touched.

It will be appreciated by those skilled in the art that the strap 1*c* may also be constructed to be extendable or adjustable to accommodate the expansion and permit the strap or straps to extend around the user's neck rather than just over the user's shoulder to enable the handbag to more easily be carried without placing too much weight on the shoulder joint.

Optionally, as shown in FIG. 3, the handbag may be modified to include a decorative plate 22 having a shape that enhances the appearance of the handbag. To add visual interest, the plate may include movable appendages 23, whose motion is responsive to opening of the handbag. For example, the illustrated plate 22 is in the shape of a hummingbird and the appendages may be shaped and positioned to resemble wings that extend as the handbag is opened. Although a particular shape is illustrated, however, it will be appreciated that the plate 22 and appendages 23 are not to be limited to any particular bird shape, or even to an animal shape, but can take a variety of forms.

In order to implement the audible content indication feature of the present invention, the handbag of the preferred embodiments includes at least the controller 5, memory 9, and a user interface, as discussed above. However, instead of or in addition to a Bluetooth of physical connection to a smartphone app, the user interface may be provided by a built-in data input 13, shown in FIG. 5, which may include a keypad, memo pad, touchscreen, or the like. Furthermore, the controller or process 5 may be utilized to implement such additional smart or convenience features as GPS location, both to assist the user in navigation and also to locate a lost handbag; control of a bar code reader useable to keep track of items in a shopping cart or purchases; and security or safety features such as an anti-theft alarm.

The handbag can also include a variety of additional functions that make use of the display, processing, and speaker capabilities, including the ability to input lists for later playback of reminders concerning individual items on the list at predetermined times through the speaker, and the ability to provide useful information such a recommended hairstyles based on forecast temperature and humidity.

Still further, the handbag of any of the preferred embodiments may include non-electronic convenience features such as an umbrella holder, extendable strap, compartments with childproof locks for medications, and so forth.

Accordingly, the invention is not to be limited by the details of the illustrated embodiments, but rather is intended to encompass any modifications or variations that may occur to those skilled in the art based on the above description, and therefore is to be limited only by the scope of the appended claims.

What is claimed is:

1. A handbag, comprising:

a main body including a base and sidewalls, or a base, sidewalls, and endwalls, configured to form an interior space into which a plurality of objects are placed by a user;

a strap to enable the handbag to be carried by the user, at least one internal compartment arranged on an inside of one of the sidewalls or endwalls and configured to hold at least one type of object of said plurality of objects;

a sensor for detecting when the at least one internal compartment is touched by the user, a processor configured to receive the sensor signal and retrieve, based on the received sensor signal, a stored indication of said at least one type of object that the at least one internal compartment is configured to hold, where said processor is further configured to generate a voice signal corresponding to the stored indication of the at least one type of object; and a speaker connected to the processor and configured to convert the voice signal into an audible indication of the at least one type object held in the at least one internal compartment when the sensor is touched.

2. A handbag as claimed in claim 1, wherein a number of said at least one internal compartment is greater than one, each of the internal compartments includes a touch sensor, and a memory is provided to store indications of the types of object to be stored in respective compartments, together with an identifier of the corresponding sensors included in the respective compartments.

3. A handbag as claimed in claim 2, further comprising a microphone, wherein the stored indication of object type for a respective compartment is input by the user through the microphone.

4. A handbag as claimed in claim 2, further comprising a smartphone interface, wherein the stored indication of object type for a respective compartment is input by the user through a smartphone app.

5. A handbag as claimed in claim 1, wherein the handbag comprises a plate member that extends from the main body and has a decorative shape, and wherein the plate member further includes movable appendages that extend when the handbag is opened.

6. A handbag as claimed in claim 5, wherein the decorative shape represents a bird, and the movable appendages are positioned to resemble wings that extend when the purse is opened.

7. A handbag as claimed in claim 1, wherein the processor is further configured to provide signals to the speaker that cause the speaker to output audible reminders at predetermined times and/or dates, the reminders corresponding to list entries input by the user.

8. A handbag as claimed in claim 1, wherein the processor is further configured to provide signals to the speaker that cause the speaker to output audible hairstyle suggestions based on temperature and humidity determined by an app executed by or in communication with the processor.

9. A handbag as claimed in claim 1, further comprising at least one of the following additional features: an umbrella pouch, a camera, a GPS chip, an extendable strap, a child-proof lock, a smartphone dock, and a USB port.

* * * * *